US005834907A

United States Patent [19]

Takehara

[11] Patent Number: 5,834,907

[45] **Date of Patent: *Nov. 10, 1998**

[54] COLD CATHODE TUBE OPERATING APPARATUS WITH PIEZOELECTRIC TRANSFORMER

[75] Inventor: Takao Takehara, Iwata-gun, Japan

[73] Assignee: Minebea Co., Ltd., Nagano, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 555,709

[22] Filed: Nov. 14, 1995

[30] Foreign Application Priority Data

Nov. 16, 1994 [JP] Japan ..... 6-307024

[51] Int. Cl.[6] ..... H05B 37/02

[52] U.S. Cl. ..... 315/307; 315/219; 315/224; 363/124

[58] Field of Search ..... 315/307, 247, 315/224, 219, 276, 209 R, DIG. 5; 363/36, 37, 124

[56] References Cited

U.S. PATENT DOCUMENTS

| | | | |
|---|---|---|---|
| 3,913,002 | 10/1975 | Steigerwald et al. | 321/2 |
| 4,350,930 | 9/1982 | Peil et al. | 315/49 |
| 5,063,490 | 11/1991 | Maehara et al. | 363/37 |

*Primary Examiner*—Robert J. Pascal
*Assistant Examiner*—David H. Vu
*Attorney, Agent, or Firm*—Staas & Halsey

[57] ABSTRACT

An inverter apparatus of the present invention has a cold cathode tube and its operating circuit provided with a piezoelectric transformer. Specifically, for increasing the boost ratio of the piezoelectric transformer, a boost chopper is mounted in the premier stage of a semi-class E voltage resonance inverter and a power switch element is mounted operable commonly for both the inverter and the chopper so that a single voltage resonance controller IC controls the cold cathode tube at a constant current. As the operating circuit is composed of the voltage transformer, the apparatus will be minimized in the number of components and decreased in the overall size and the production cost. Also, as the operating frequency of the cold cathode tube is increased by increasing the resonance frequency of the piezoelectric frequency, the discharge efficiency will also be enhanced.

3 Claims, 7 Drawing Sheets

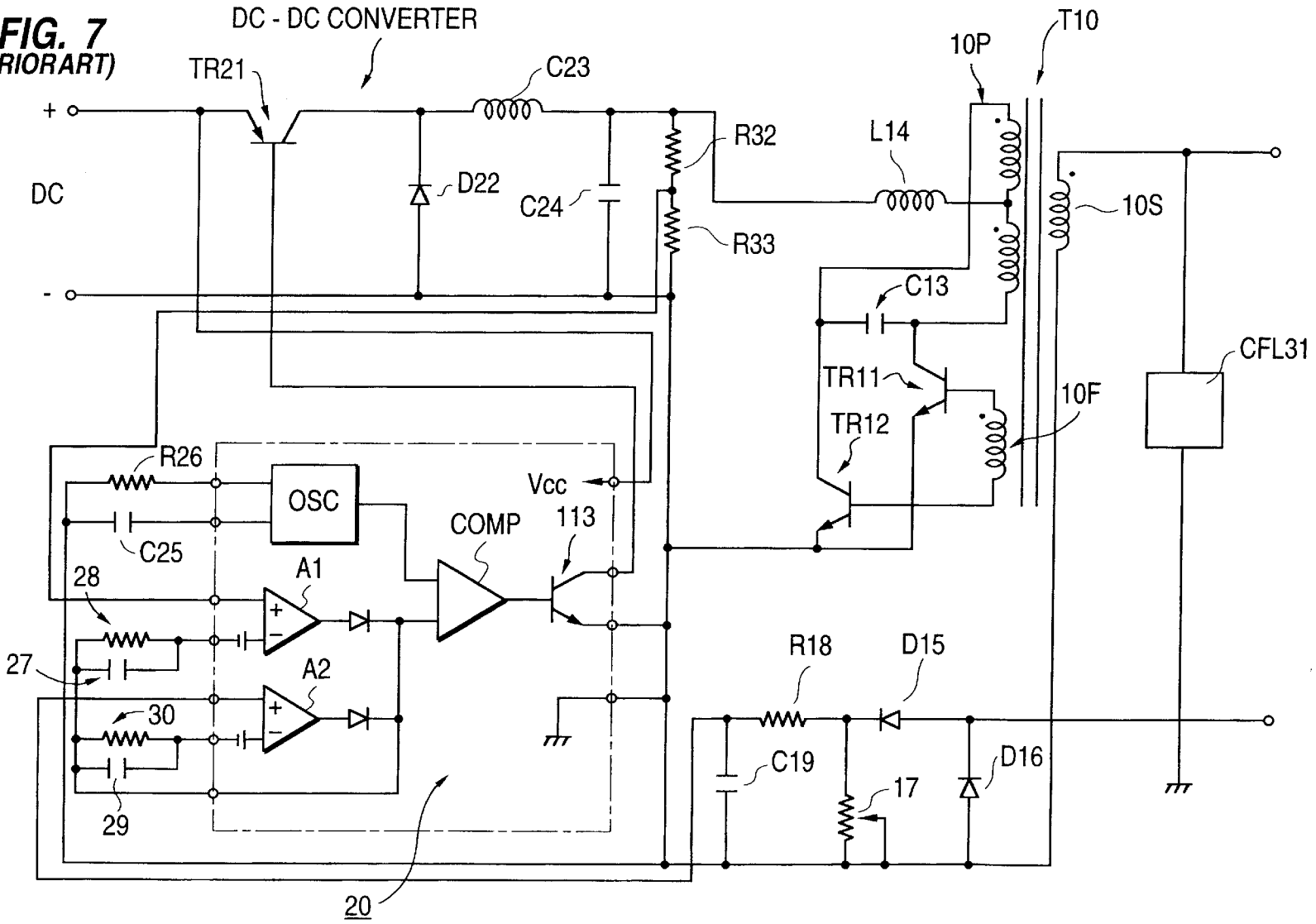
FIG. 7
(PRIORART)

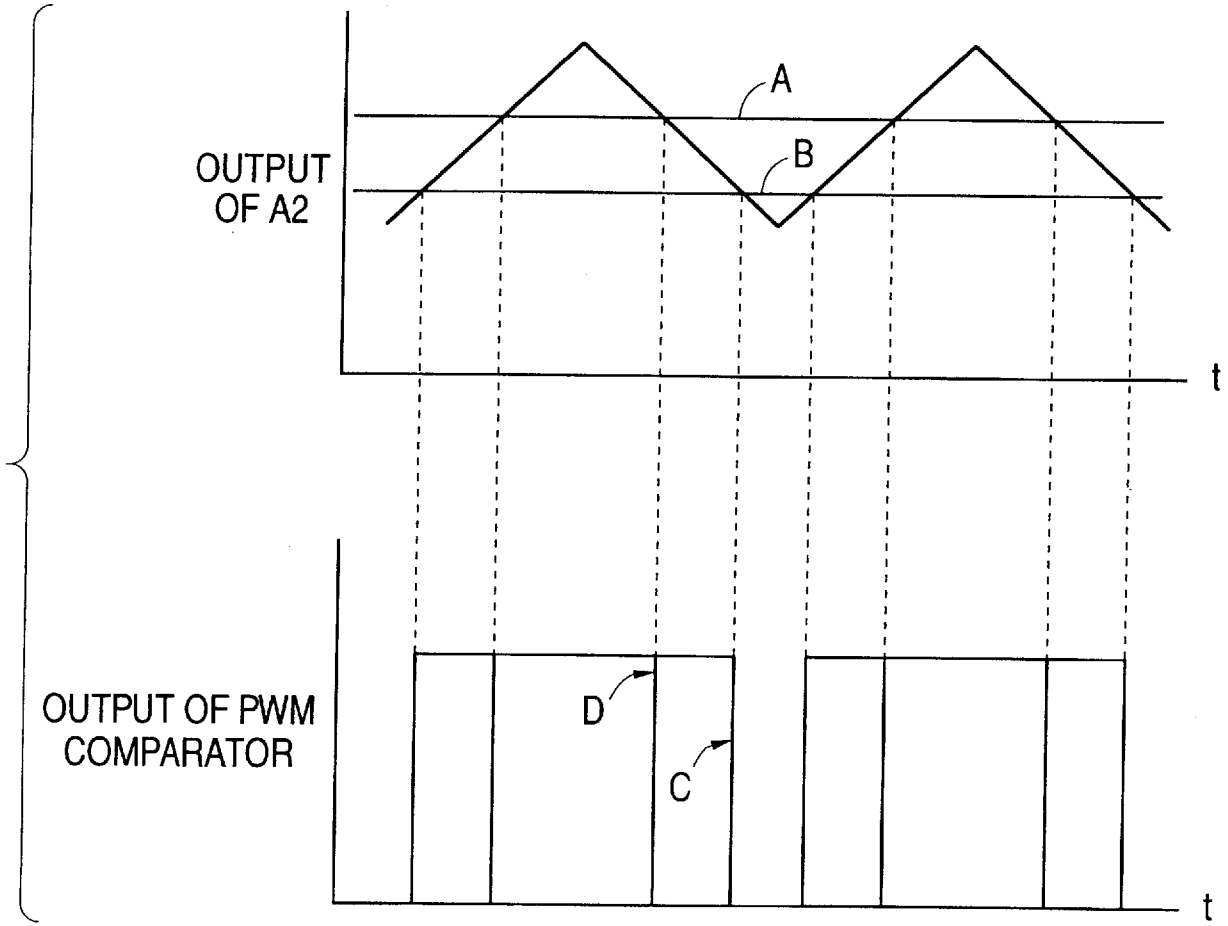
FIG. 8
(PRIORART)

COLD CATHODE TUBE OPERATING APPARATUS WITH PIEZOELECTRIC TRANSFORMER

BACKGROUND OF THE INVENTION 1. (Field of the Invention)

The present invention relates to a cold cathode tube operating apparatus for supply of electric power to a load which has to be controlled in a wide range of current, and more specifically, to a cold cathode tube operating apparatus appropriate for use with a light source employing a cold cathode tube with a dimmer.

2. (Description of the Prior Art)

Inverter apparatus are provided for converting a direct current of electric power to an alternating current form and also known as an inverse converter for use in a variety of electric systems.

FIG.7 shows a circuit diagram of a conventional inverter apparatus specified for discharge tube. As shown in FIG.7, a booster transformer T10 in a Royer oscillator circuit comprises a primary coil 10P, a secondary coil 10S, and a feedback coil 10F. The Royer oscillator circuit includes NPN switching transistors TR11 and TR12 as well as the booster transformer T10. There are also provided a capacitor C13 for voltage resonance and a choke coil L14. Accordingly, when the transistors TR11 and TR12 are not conducted, their collector-emitter voltage has a sine-wave and the waveform of voltage at the primary coil 10P and secondary coil 10S of the transformer T10 is also a sine-wave. The choke coil L14 is connected at input to a DC/DC converter described later and at output to a cold cathode tube CFL31. As the inverter performs self-oscillation, its output delivers a high voltage of sine-wave having a frequency of some tens KHz and hence, the cold cathode tube CFL31 is illuminated. Also, an integrated circuit (IC) 20 is provided which serves as a step-down chopper for controlling the base of a PNP switching transistor TR21 which is a component of the DC/DC converter. The IC 20 comprises an oscillator OSC for producing a triangle wave, two operational amplifiers A1 and A2 for comparing action, a PWM comparator COMP for comparing between output of the oscillator OSC and output of one of the two operational amplifiers A1 and A2, and an output transistor 113 driven by the PWM comparator for conducting the base of the PNP switching transistor TR21. The PWM comparator of the IC 20 comprises two comparing inputs, one connected to the oscillator OSC and the other to the two operational amplifiers A1 and A2. The output of the oscillator OSC is compared with a higher one of the two voltage outputs of their respective operational amplifiers A1 and A2. The IC 20 will now be defined to as a DC/DC converter controlling IC, even if the IC 20 may be used for other applications so long as its arrangement is not modified. Further shown are a fly-wheel diode D22, a choke coil L23, and a capacitor C24 which constitute in combination an LC filter. Denoted by C25 and R26 are a capacitor and a resistor respectively for determining the frequency of oscillation. There are C and R elements 27 to 30 for adjusting the paired inputs of the operational amplifiers A1 and A2 in phase with each other in the IC 20. Two diodes D15 and D16 are connected for rectifying positive components of a discharge current across the cold cathode tube CFL31. R18 and C19 are a resistor and a capacitor respectively which form a lowpass filter for shaping the current waveform. The output of the lowpass filter is connected to a positive input of the operational amplifier A2 in the DC/DC converter controlling IC 20. In action, a voltage which is proportional to an average of positive cycles of the discharge current appears across the capacitor C19. The voltage is then compared by the operational amplifier A2 with a reference voltage of the DC/DC converter controlling IC 20. A resultant voltage output is proportional to a difference between the two voltages. The resultant voltage output is fed to the PWM comparator where it is compared with the triangle waveform of the oscillator OSC in the DC/DC converter controlling IC 20, as shown in FIG. 8. If the discharge current is increased by any incident, the voltage output of the operational amplifier A2 is shifted from the line B to the line A. This causes the output of the PWM comparator to shift from the line C to the line D. Accordingly, the on-time of the PNP switching transistor TR21 is decreased attenuating the voltage output of the DC/DC converter and thus the source voltage of the Royer oscillator circuit. As the result, the discharge current is decreased.

In other words, the discharge current can be controlled to a constant rate. Denoted by R32 and R33 are resistors for adjusting the voltage output of the DC/DC converter to a constant level. If the cold cathode tube CFL 31 is not installed, the resistors R32 and R33 detect and control the voltage output of the DC/DC converter for setting the voltage across the secondary coil 10S of the booster transformer T10 to a constant level before starting a discharge action. The joint between the two resistors R32 and R33 is connected to the positive input of the operational amplifier A1 in the DC/DC converter controlling IC 20, thus forming a negative feedback loop and allowing a constant voltage output from the DC/DC converter. Both outputs of the operational amplifiers A1 and A2 are OR connected so that a higher level of the two outputs of the amplifiers A1 and A2 is selectively transferred to the PWM comparator.

The high voltage of 1000 V to 1500 V for conducting the cold cathode tube is produced by boosting a primary voltage of 5 V to 19 V with the booster transformer of which a secondary side carries several thousands of turns of a small wire of about 40 micrometers in diameter. The booster transformer having coils of such small wires may generate some unwanted artifacts including wire breakage and layer shortcircuit and also, require a large number of steps for fabrication. As the booster transformer of coil type is commonly used in a note computer, it will disturb the minimum dimensions of the computer. For compensation, a method has been proposed in which the booster transformer of coil type is substituted with a ceramic piezoelectric transformer.

It is however needed for increasing a boost ratio of the piezoelectric transformer to increase the widthwise dimension and reduce the thickness of ceramic core plates. When the thickness of the core plates is decreased, the area of their driver region will be increased relative to that of their generator region. Simultaneously, output impedance may also be increased causing a variation in the output voltage to the load to rise. When the widthwise dimension is increased, the output impedance may be reduced. However, as the electromechanical coupling factors K31 and K33 depend on a shape of the core plates, they are declined when the ratio of width to length is more than 0.3. More specifically, increase of the width is limited and the boost ratio may be decreased if the width is too large. With the respect to reduction of the overall size, the boost ratio has a limit. It is also known for having an optimum of the boost ratio to use a common winding transformer for boosting the voltage to drive the piezoelectric transformer. This will however increase both the cost and the overall size.

It is an object of the present invention, in view of the foregoing predicaments, to provide a cold cathode tube operating apparatus with a piezoelectric transformer for operating and controlling a cold cathode tube while undesired artifacts caused in its inverter circuit by a conventional transformer of winding type will be eliminated by the use of the piezoelectric transformer.

SUMMARY OF THE INVENTION

For achievement of the above object of the present invention, a cold cathode tube operating apparatus with a piezoelectric transformer according to the present invention is provided having a cold cathode tube and a piezoelectric transformer for operating the cold cathode tube, and characterized by a serial resonance circuit provided at the primary side of the piezoelectric transformer, a controlling means for turning on and off the serial resonance circuit by conducting a switching element at the timing of phase advanced from the resonance frequency of the serial resonance circuit, a chopper circuit for supplying the resonance circuit with an amount of power produced by boosting the input voltage with the action of the switching element, and the cold cathode tube connected at the secondary side of the piezoelectric booster transformer. The cold cathode tube operating apparatus with a piezoelectric transformer according to the present invention may include a feedback circuit responsive to a feedback signal from the current across the cold cathode tube for determining the switching conditions of the switching circuit. Also, it may be arranged in which the controlling means includes a soft start circuit for decreasing the switching frequency of an inverter circuit of the apparatus gradually from a value of the resonance frequency of the piezoelectric transformer.

The cold cathode tube operating apparatus with a piezoelectric transformer according to the present invention allows the piezoelectric transformer to form an illumination driving circuit, thus minimizing the number of its components and decreasing the overall size and the production cost. It is also possible to increase the operating frequency of the cold cathode tube for having a higher discharge efficiency by increasing the resonance frequency of the piezoelectric transformer.

BRIEF DESCRIPTION OF THE DRAWING(S)

FIG. 7 is a circuit diagram of a prior art. and

FIG.8 is an operating waveform diagram of the prior art.

DESCRIPTION OF THE PREFERRED EMBODIMENT(S)

Figure 1:
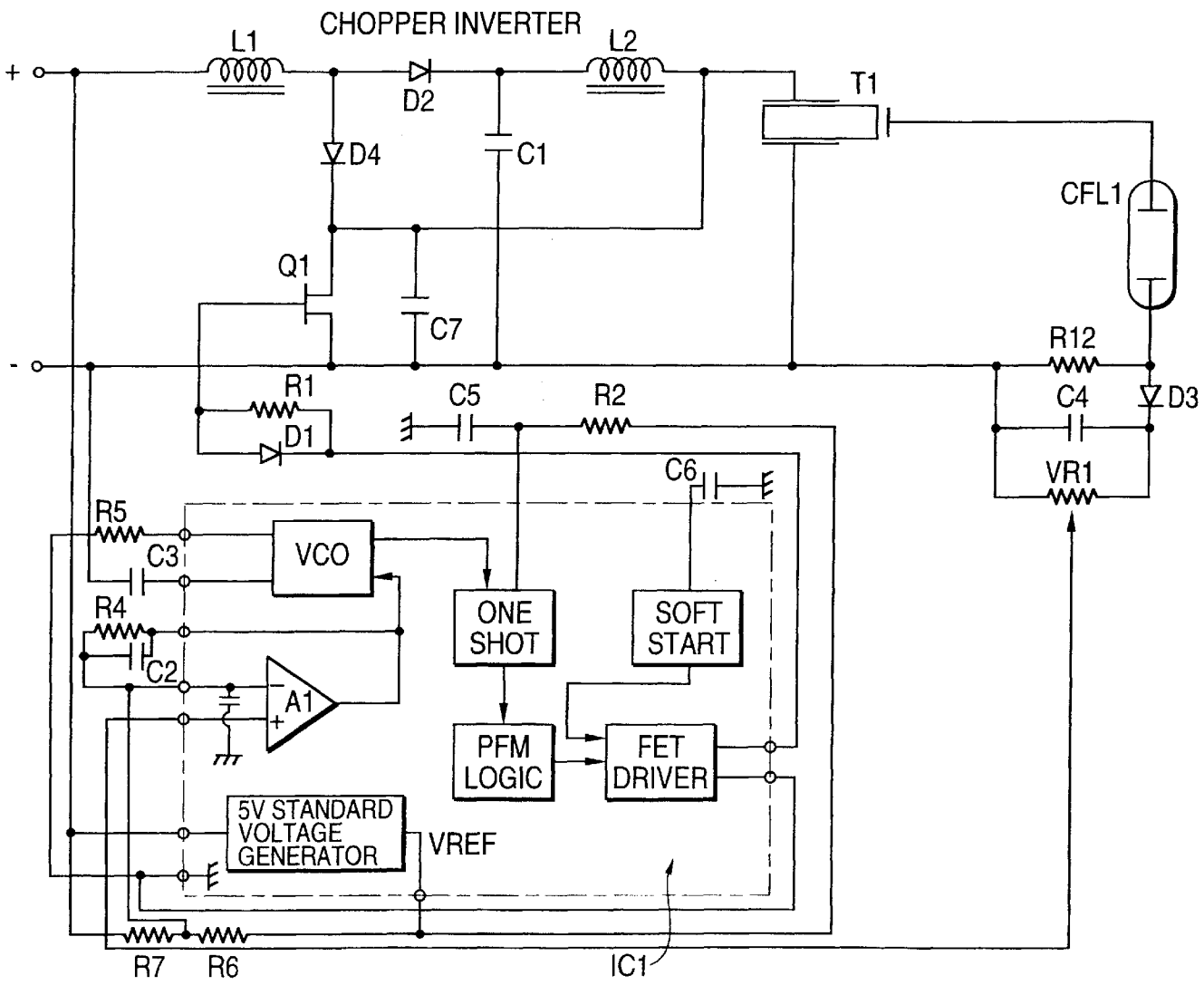
FIG. 1 is a circuit diagram showing one embodiment of the present invention.

One preferred embodiment of the present invention will be described in detail referring to the accompanying drawings. FIG. 1 is a circuit diagram of a cold cathode tube operating apparatus provided with the piezoelectric transformer according to the present invention. In a prior art shown in FIG. 7, the cold cathode tube is dimmer controlled by varying the output voltage of a Royer oscillator circuit or DC/DC converter according to a value of discharge current. While the present invention allows the output of the booster chopper circuit to be connected via a single power switching element to a semi-class E voltage resonance inverter circuit for driving directly the cold cathode tube or CFL1, the current across the CFL1 is returned in negative feedback to a power switching circuit for optimum illumination control.

Figure 2:
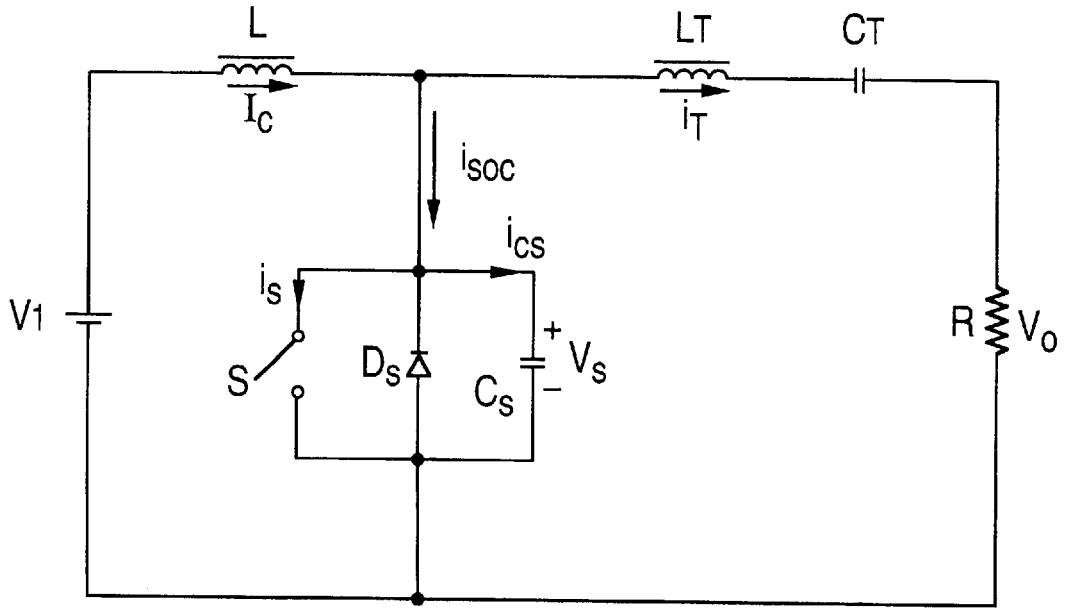
FIG. 2 is a diagram of a basic circuit of a semi-class E type voltage resonance inverter.

As known, the semi-class E voltage resonance inverter is capable of producing a sine-wave output as a current across its power switching element has a sine-wave component and a voltage supplied to its switch has a sine-wave form. The principle of action of the semi-class E voltage resonance inverter will now be explained referring to FIG. 2. FIG. 2 illustrates a basic circuit of the semi-class E voltage resonance inverter. As shown, the choke coil is a reactor L of its current is approximately a direct current Ic. An inductor $L_T$ and a capacitor $C_T$ constitute a resonance circuit. Through turn-on and turn-off actions of the switch, a pulse form of voltage is supplied to an RLC tuning circuit. When the switching frequency is slightly higher than the $L_T$-$C_T$ resonance frequency, a current across R-$L_T$-$C_T$ in the tuning circuit is approximately a sine-wave. In that case, the R-L-C tuning circuit has an inductive reactance and its current it is out of phase with the voltage which is a fundamental wave of the switch voltage Vs. As Ic=isdc+it is established, Isdc across a parallel circuit comprising a switch S, a diode $D_s$, and a capacitor $C_s$ is calculated by subtracting the sine-wave $i_T$ from the direct current Ic and its waveform is a sine-wave.

Figure 3A:
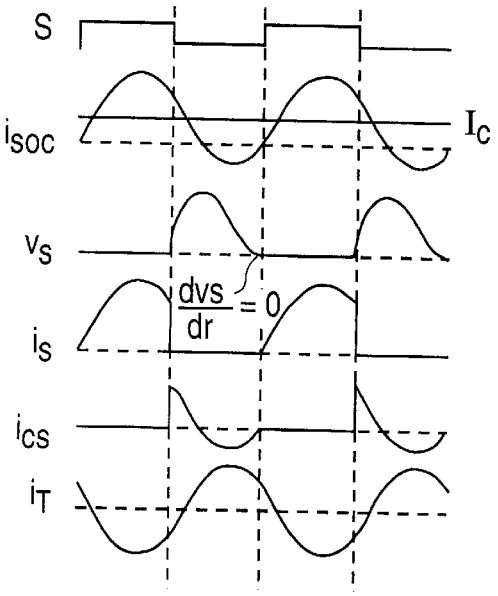
FIG. 3A is an optimum operation waveform diagram of a class E resonance inverter.
Figure 3B:
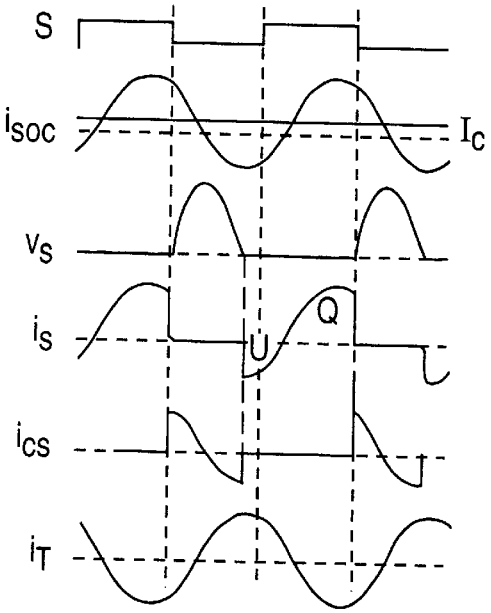
FIG. 3B is an operation wave form of a semi-class E resonance inverter.

FIG. 3(*a*) shows operating waveforms in the class E resonance inverter with the switch having 50% of a duty. When the switch S is turned off, the sine-wave current flows across the capacitor $C_s$ which is then charged and the voltage $v_s$ rises up from zero to form a sine-wave. S is an input signal of switching drive. Accordingly, the turn off action of the switch triggers zero voltage, non-zero current switching. The switch voltage Vs drops in a near-zero gradient of dVs/dt at an optimum load Ropt, as shown in FIG. 3(*a*). When $v_s$=0 and $dv_s/dt$=0, the switch S is turned on. If the resistance load is smaller than Ropt, the voltage $v_s$ of the switch is clamped to zero, as shown in FIG. 3(*b*), and allows the switch S to remain closed. This is a semi-class E action implementing zero voltage switching similar to the action of a voltage resonance switch. When the circuit is used as a switching regulator, the class E action cannot be executed throughout the full-scale viable range of load and input voltages but the semi-class E action will be feasible. Since the impedance in the R-L-C tuning circuit is highly responsive to the switching frequency, control of the output voltage Vo (=It) with switching frequency modulation will minimize a change in the switching frequency.

Figure 4:
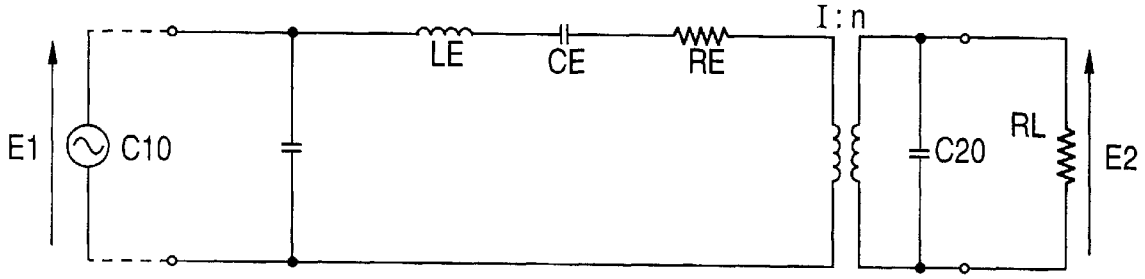
FIG. 4 is an equivalent circuit diagram of a piezoelectric transformer.
Figure 5:
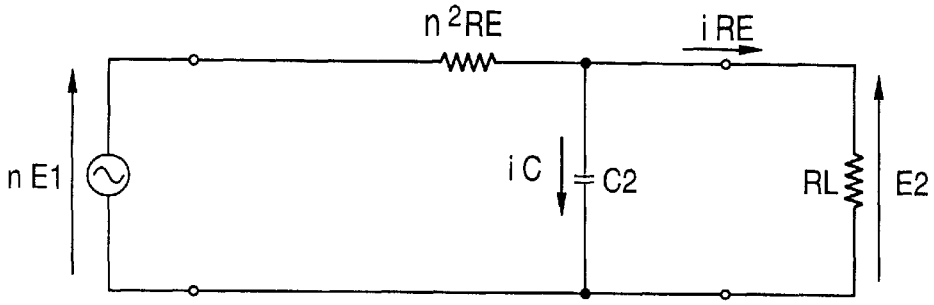
FIG. 5 is an equivalent circuit diagram of the piezoelectric transformer.

Returning to FIG. 1, T1 is a piezoelectric transformer. FIG. 4 is an equivalent circuit of the piezoelectric transformer in which shown are an input capacitance C10, an output capacitance C20, an equivalent inductance LE, an equivalent capacitance CE, an equivalent resistance RE, a transformation ratio n, and a negative resistance RL. Assuming for more simplification that LE and CE are resonant with each other, the secondary side is as illustrated in FIG. 5.

As shown in FIG. 1, there are also provided an N-channel power MOSFET Q1 and a choke coil L2. The resonance circuit is composed of the equivalent capacitance CE and the equivalent inductance LE of the piezoelectric transformer T1. The piezoelectric transformer T1 is connected in series to the cold cathode tube CFL1. The resonance frequency Fr of the resonance circuit is expressed by:

$$Fr = 1/2\pi\sqrt{LE \cdot CE}$$

Figure 6A:
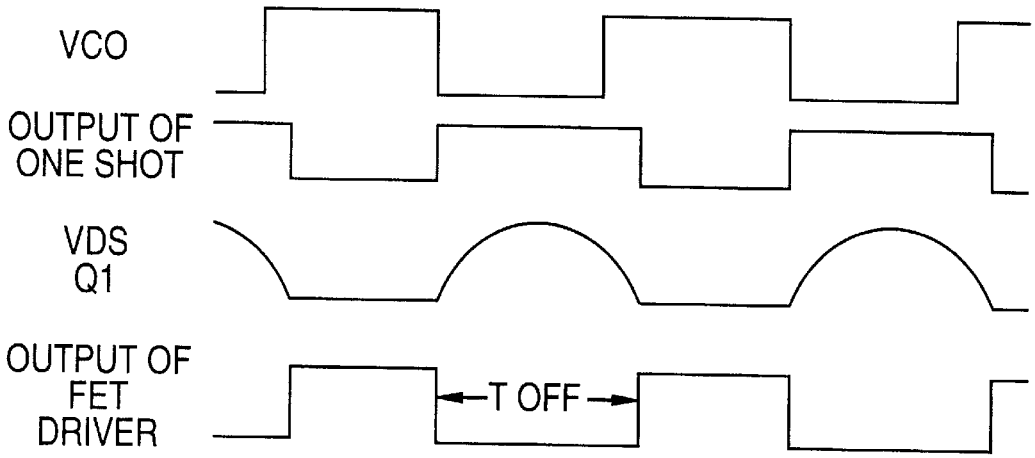
FIG. 6A is an operational waveform diagram at relative points when lamp current is large in the embodiment of the present invention.
Figure 6B:
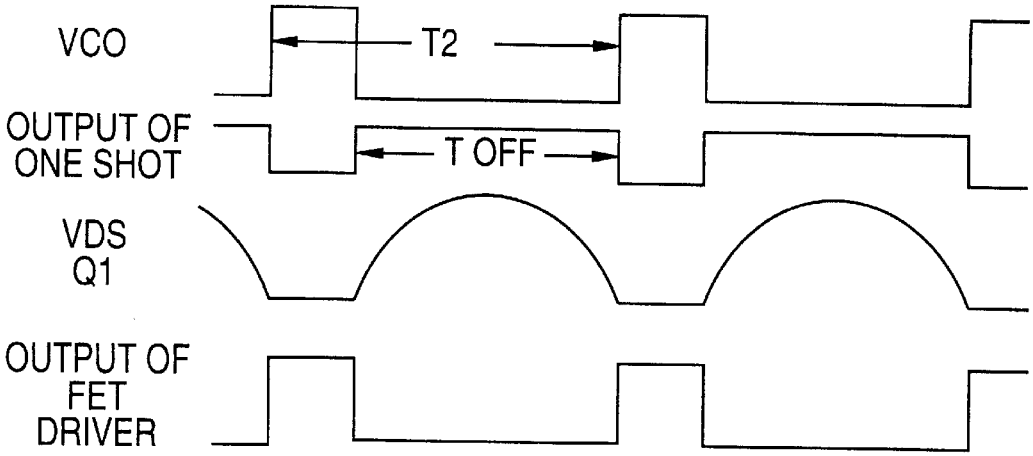
FIG. 6B is an operational waveform diagram at relative points when lamp current is small in the embodiment of the present invention.

When Q1 is not conducted, its voltage between drain and source has a sine-wave due to a choke coil L2 and a capacitor C7. The capacitor C7 is for voltage resonance action. The choke coil L1 and the power MOSFET Q1 form a boost chopper circuit together with a diode D2, a diode D4, and a capacitor C1. A boosted output of the chopper circuit is fed to the semi-class E voltage resonance inverter circuit. The power MOSFET Q1 serves as a common power switch for both the boost chopper circuit and the semi-class E voltage resonance circuit. Denoted by IC1 is a voltage resonance switching IC for controlling the gate of the power MOSFET Q1. The voltage resonance switching IC comprises a voltage-controlled oscillator (VCO), an operational amplifier A1, a switching frequency modulator circuit (PFMLOGIC), a FET driver driven by FEMLOGIC for conducting the gate of the power MOSFET Q1 and standard voltage(5V) generator. There are provided a resistance R4 and a capacitor C2 for adjusting the two inputs of the operational amplifier A1 in phase with each other in the voltage resonance switching IC. A C-R element comprises R5 and C3 for determining the oscillation frequency of the voltage-controlled oscillator (VCO). R6 and R7 are resistors for DC biasing at the negative input of the operational amplifier A1 in IC1. There are also provided a gate drive resistor R1 for the power MOSFET Q1, a speed-up diode D1 for releasing a gate accumulated charge, and a resistor R12 for detecting a lamp current. A combination of a diode D3 and a capacitor C4 is provided for detecting the positive cycles of a lamp current to produce direct current and its output is transferred through a lamp current setting variable resistor VR1 and a resistor R8 to the positive input of the operational amplifier A1 in IC1. More particularly, the center tap of the variable resistor VR1 draws a voltage proportional to an average of the positive cycles of discharge current and sends it to the input of the voltage-controlled oscillator VCO for controlling its oscillation frequency. Accordingly, if the discharge current is increased by any incident, the output of the operational amplifier A1 rises thus increasing the oscillation frequency of the voltage-controlled oscillator. In response to a hang down of the output of the voltage-controlled oscillator, a monostable multivibrator (ONESHOT) is initiated producing a high level output. The output of the monostable multivibrator is maintained at the high level by a resistor R2 and a capacitor C5 throughout a duration which may be determined by a pulse-width setting time constant of the monostable multivibrator. FIGS. 6A and 6B show waveforms at the relative points, in which Toff is determined considering a variation in the performance of the choke coil L and voltage resonance capacitor CS and a change in the resonance frequency due to thermal variation so that the semi-class E action is successfully carried out. FIG. 6A shows waveforms when lamp current is large, and FIG. 6B shows waveforms when lamp current is small. When the oscillation frequency increases with Toff remaining unchanged, the on duration of the switch is decreased thus lowering the input current of CFL1 to a constant rate. If the lamp current drops, the output of the operational amplifier A1 is decreased thus lowering the oscillation frequency of the voltage-controlled oscillator and allowing the supply of a constant current. C6 is a capacitor for determining a delay time of the soft start circuit. When loaded with a voltage, VCO produces a higher rate of the oscillation frequency than a normal action rate. The oscillation frequency will be decreased as the capacitor C6 being charged.

For starting a discharging action in CFL1, the CFL has to be loaded with a high voltage (commonly, 1 KV to 1.5 KV). This voltage is called a release voltage. While CFL1 is not conducted, its resistance is great. When the oscillation frequency of the voltage-controlled oscillator VCO in IC1 is equal to the resonance frequency Fr, the output C of the piezoelectric transformer T1 releases a high voltage thus illuminating CFL1. As CFL1 is turned on, its impedance drops down sharply. As the piezoelectric transformer T1 has a constant current characteristic due to its intrinsic resistance R, its output is decreased. Accordingly, this action eliminates the need of a ballast capacitor essential in the prior art using a winding type transformer. When the power source is connected, the soft start circuit of IC1 causes its switching frequency to be equal to the resonance frequency Fr of the piezoelectric transformer T1 thus turning on CFL1. Assuming that the piezoelectric transformer T1 has a thickness of d and a length of L, its boost ratio n is expressed by n oc L/D but may still be limited by the prescribed reason. It would be understood that the battery voltage output for a known note computer has constantly been requested to be lower. Hence, the boost ratio of the piezoelectric transformer T1 should be increased. The present invention allows the chopper circuit to be-mounted in a pre-stage of the semi-class E voltage resonance inverter for increasing a voltage input to the inverter, thus ensuring an equivalent increase of the boost ratio n of the piezoelectric transformer T1.

As set forth above, the booster chopper is mounted in the premier stage of the semi-class E voltage resonance inverter for increasing the boost ratio of the piezoelectric transformer. In action, the cold cathode tube is controlled with a constant current by the action of a single voltage resonance controller IC actuated by a single power switch. Therefore, the apparatus of the present invention will be minimized in the number of its inverter components, thus being low in the cost and high in the operational efficiency.

As the operating frequency of the cold cathode tube is increased by increasing the resonance frequency of the piezoelectric frequency, the discharge efficiency will also be enhanced.

I claim:

1. A cold cathode tube operating apparatus, comprising:

a piezoelectric transformer with primary and secondary sides, the cold cathode tube being connected to the secondary side of the piezoelectric transformer;

a semi-class E voltage resonance inverter connected to the primary side of the piezoelectric transformer;

a chopper circuit for producing a power supply from an input voltage boosted by a switching signal, and supplying the power supply to the resonance inverter;

a single power switch for selectively powering both the resonance inverter and the switching signal; and a controller for turning the single power switch on and off in a phase ahead of a wave oscillating at a resonance frequency of the resonance inverter.

2. A cold cathode tube operating apparatus according to claim 1, further comprising a feedback circuit producing a feedback signal based on a current across the cold cathode tube, the feedback signal being supplied to the controller for controlling the frequency at which the single power switch is turned on and off.

3. A cold cathode tube operating apparatus according to claim 1, wherein the controller includes a soft starter for gradually decreasing the frequency at which the single power switch is turned on and off, from a resonance frequency of the piezoelectric transformer.

* * * * *